US005126237A

United States Patent [19]

Okumura et al.

[11] Patent Number: 5,126,237

[45] Date of Patent: Jun. 30, 1992

[54] SILVER HALIDE LIGHT-SENSITIVE PHOTOGRAPHIC MATERIAL

[75] Inventors: Mitsuhiro Okumura; Masataka Nakano, both of Hino, Japan

[73] Assignee: Konica Corporation, Tokyo, Japan

[21] Appl. No.: 566,666

[22] Filed: Aug. 13, 1990

[30] Foreign Application Priority Data

Aug. 18, 1989 [JP] Japan ..... 1-212570

[51] Int. Cl.[5] ..... G03C 1/29

[52] U.S. Cl. ..... 430/577; 430/139; 430/523; 430/571; 430/574; 430/576; 430/584; 430/933; 430/950

[58] Field of Search ..... 430/950, 933, 139, 584, 430/572, 571, 574, 576, 577

[56] References Cited

U.S. PATENT DOCUMENTS

| | | | |
|---|---|---|---|
| 3,808,009 | 4/1974 | Sakazume et al. | 430/577 |
| 4,047,964 | 9/1977 | Hinata et al. | 430/577 |
| 4,442,201 | 4/1984 | Takada et al. | 430/577 |

FOREIGN PATENT DOCUMENTS

| | | | |
|---|---|---|---|
| 63-096651 | 4/1988 | Japan | 430/574 |

*Primary Examiner*—Marion E. McCamish
*Assistant Examiner*—Janis L. Dote
*Attorney, Agent, or Firm*—Frishauf, Holtz, Goodman & Woodward

[57] ABSTRACT

There is disclosed a monochromatic silver halide light-sensitive photographic material for printing from a color negative, which has an excellent sensitivity, sharpness, graininess and background whiteness. The photographic material is characterized by that the surface of the support on which the emulsion layer is provided has the following reflection properties:

L=90 or more
a*=−0.5 to 1.0
b*=−5.0 to −1.5 and that the silver halide emulsion layer contains in combination the dyes represented by Formulas I, II and III:

Formula I

Formula II

Formula III

20 Claims, No Drawings

SILVER HALIDE LIGHT-SENSITIVE PHOTOGRAPHIC MATERIAL

FIELD OF THE INVENTION

The present invention relates to a monochromatic silver halide light-sensitive photographic material for printing from a color negative film, specifically to a silver halide light-sensitive material having improved whiteness of a background and excellent image reproducibility.

BACKGROUND OF THE INVENTION

In recent years, there are increasing cases where a black and white image is printed on monochromatic printing paper from a color negative.

In particular, in newspaper offices and news agencies, use of a color negative for printing on a monochromatic light-sensitive material has been rapidly increasing, since better cost performance can be expected if color photogravures and monochromatic prints can be prepared from the same color negative.

Monochromatic printing paper on which an image is printed from a color negative is required to have higher contrast and spectral sensitivities to blue, green and red light.

To satisfy these requirements, a light-sensitive material for monochromatic printing paper is spectrally sensitized by several kinds of sensitizing dyes in large amounts.

Japanese Patent Publication Open to Public Inspection (hereinafter referred to as Japanese O.P.I. publication) No. 259554/1988 discloses that safe light property and graininess can be improved by spectral sensitization to a specific wavelength region. Meanwhile, the present inventors disclose in Japanese Patent Application No. 123288/1989 that photographic properties and safe light property can be improved by controlling a relative sensitivity of each color-sensitive region.

In these techniques having no bleaching process for desilvering, quality of developed images is sometimes liable to deteriorate due to stain caused by residual dyes.

Consequently, there is required a monochromatic light-sensitive material having excellent photographic properties and safe light property, and free from color stain.

SUMMARY OF THE INVENTION

The object of the present invention is to provide a monochromatic silver halide light-sensitive photographic material for printing from a color negative film, which not only has excellent color sensitivity, sharpness, graininess and safe light property, but also is free from color stain and has excellent whiteness of a background.

The above object can be attained by a silver halide light-sensitive material comprising a support and provided thereon the photographic component layers including at least one emulsion layer, wherein the surface of the support on which the emulsion layer is provided has the following reflection properties:

L = not less than 90

$a^* = -0.5$ to 1.0

$b^* = -5.0$ to $-1.5$ and the silver halide emulsion layer contains at least one each of the dyes (1) and (2) represented by Formula I and II, respectively, or at least one each of the dyes (1) and (2) and the dye (3) represented by Formula III:

Formula I

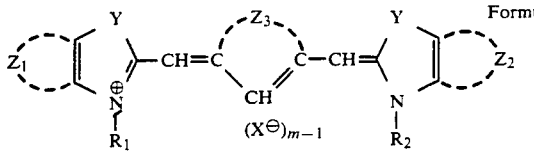

wherein $R_1$ and $R_2$ each represent an alkyl group; $Z_1$ and $Z_2$ each represent the group of non-metallic atoms necessary for forming a benzene ring and a naphthalene ring each condensed with a thiazole ring or a selenazole ring; $Z_3$ represents the group of atoms necessary for forming a 6-membered hydrocarbon ring; m is 1 or 2; Y represents a sulfur atom or a selenium atom; and X represents an anion;

Formula II

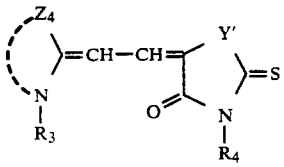

wherein $Z_4$ represents the group of non-metallic atoms necessary for forming an oxazole ring, a benzoxazole ring, a naphthoxazole ring, a thiazole ring, a benzothiazole ring, a naphthothiazole ring or a thiazoline ring; Y' represents a sulfur atom or —NR'— in which R' represents an alkyl group or an aryl group; $R_3$ represents an alkyl group; and $R_4$ represents an alkyl group, an aryl group or a 2-pyridinyl group;

Formula III

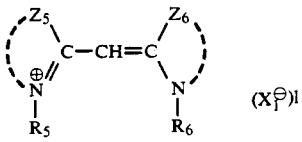

wherein $Z_5$ and $Z_6$ each represent the group of non-metallic atoms necessary for forming an oxazole ring, benzothiazole a thiazole ring, a selenazole ring, a pyridine ring, a benzoxazole ring, a benzoselenazole ring, a benzoimidazole ring, a naphthoxazole ring, a naphthothiazole ring, a naphthoselenazole ring, a naphthoimidazole ring, and a quinoline ring; $R_5$ and $R_6$ each represent an alkyl group, an alkenyl group and an aryl group; $X_1^{\ominus}$ represents an anion; and l is 0 or 1.

DETAILED DESCRIPTION OF THE INVENTION $R_1$ and $R_2$ in Formula I each represent a linear or branched alkyl group, which may have a substituent. The examples of the alkyl group are methyl, ethyl, propyl, chloroethyl, hydroxyethyl, methoxyethyl, acetoxyethyl, carboxyethyl, ethoxycarbonylmethyl, sulfoethyl, sulfopropyl, sulfobutyl, β-hydroxy-γ-sulfopropyl, sulfadepropyl, allyl and benzyl. A heterocyclic ring formed by $Z_1$ or $Z_2$ may have a substituent such as a halogen atom, an aryl group, an allyl group and an alkoxy group, preferably a halogen atom, a phenyl group or a methoxy group.

$X^{\ominus}$ represents an anion such as Cl, Br, I,

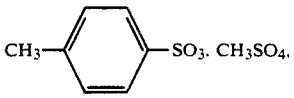
and $C_2H_5SO_4$. m is 1 or 2, provided that m is 1 when the compound forms an intramolecular salt. The examples of the dye (1) represented by Formula I are given below:
I-1
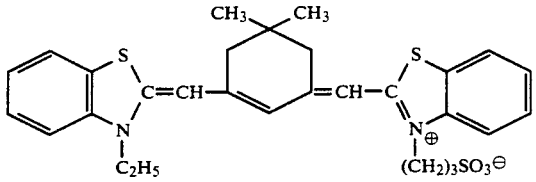
I-2
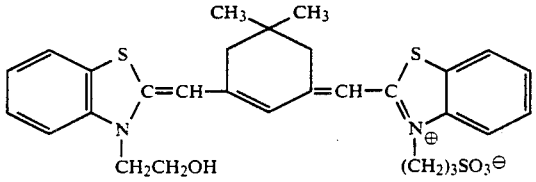
I-3
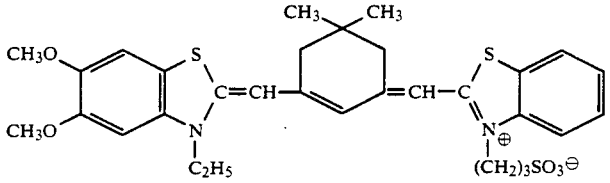
I-4
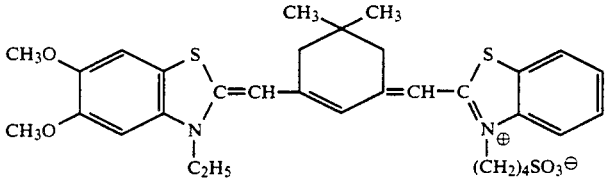
I-5
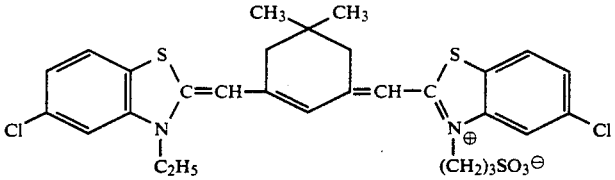
I-6
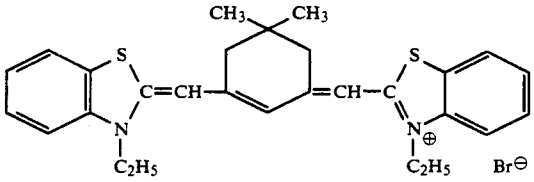
I-7
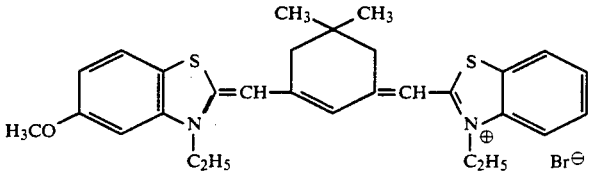

-continued

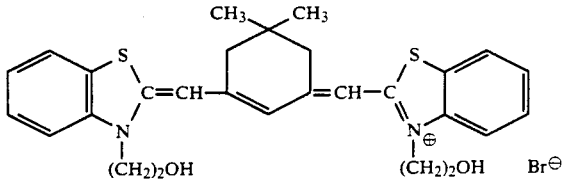

I-8

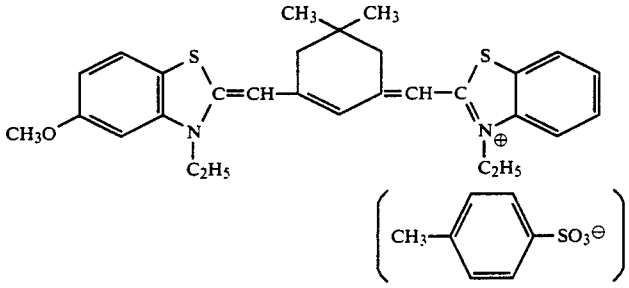

I-9

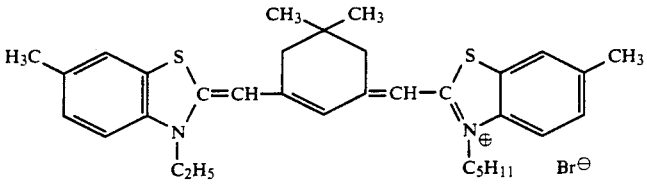

I-10

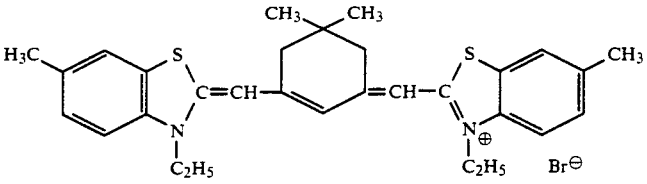

I-11

In Formula II, the heterocycle formed by $Z_4$ may have a substituent such as an alkyl group with 1 to 4 carbon atoms, an alkoxy group, a phenyl group, an alkoxycarbonyl group and a halogen atom.

The alkyl groups represented by $R_3$ and $R_4$ are the same as those represented by $R_1$ and $R_2$ in Formula I.

The examples of the alkyl and aryl groups represented by R′ are an alkoxycarbonylalkyl group, a hydroxyalkyl group, a hydroxyalkoxyalkyl group, a carbamoylalkyl group, a hydroxyphenyl group, a hydroxyalkylphenyl group, and $-(CH_2)_n-A$, wherein A represents a nitrile group, an alkylsulfonyl group, a sulfonamide group, an alkylsulfonylamino group, or a lower alkoxy group, and n represents an integer of 1 to 4.

The examples of the dye (2) represented by Formula II are given below:

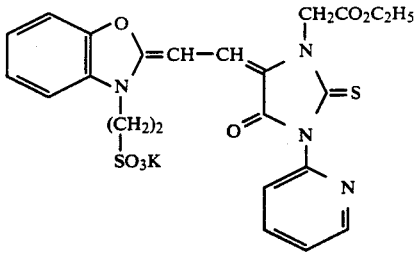

II-1

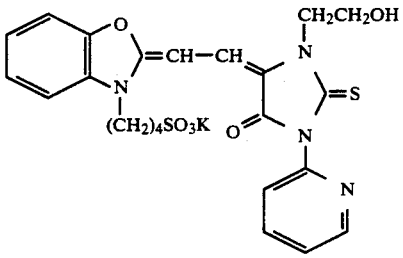

II-2

-continued
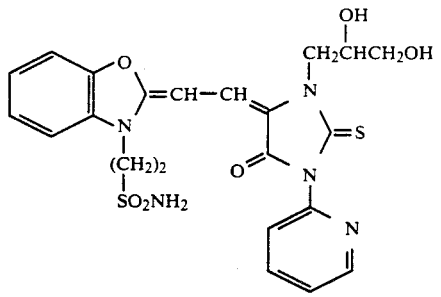
II-3
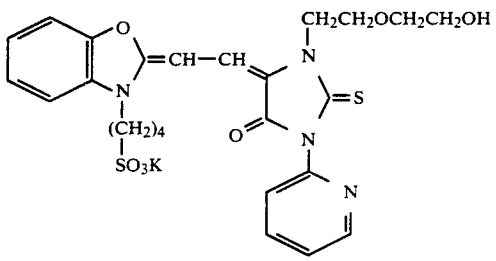
II-4
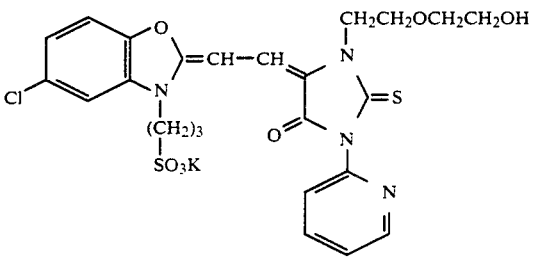
II-5
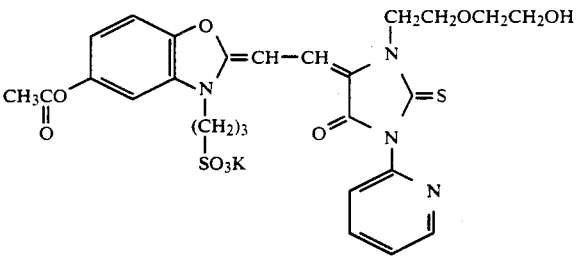
II-6
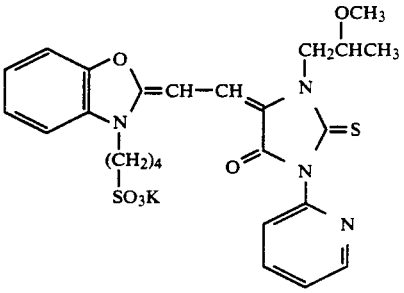
II-7

-continued
II-8
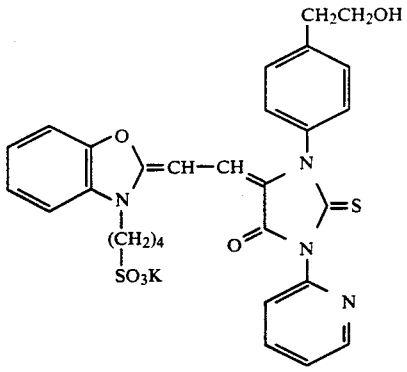
II-9
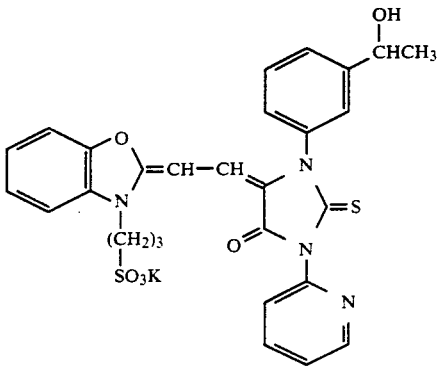
II-10
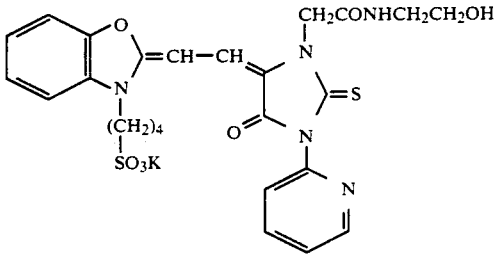
II-11
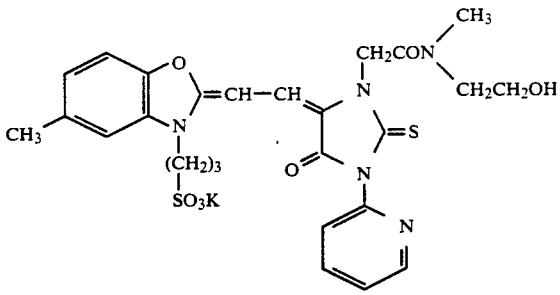
II-12
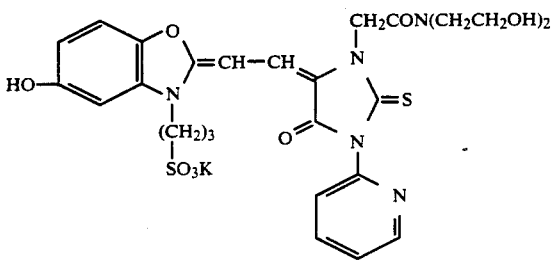

-continued
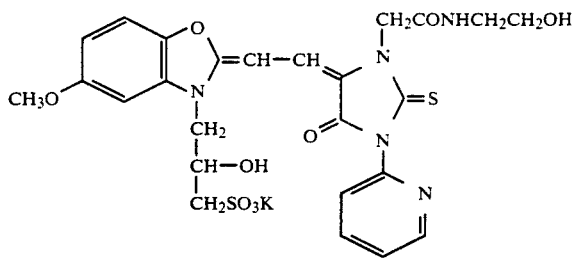
II-13
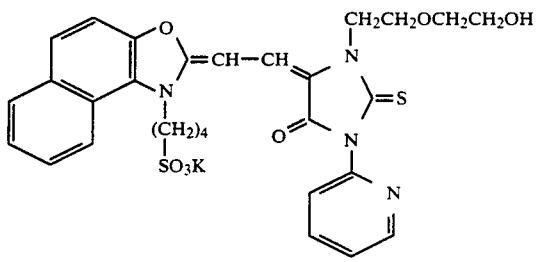
II-14
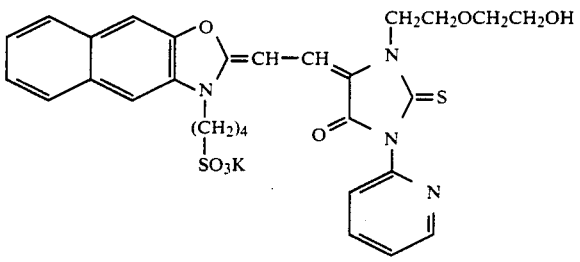
II-15
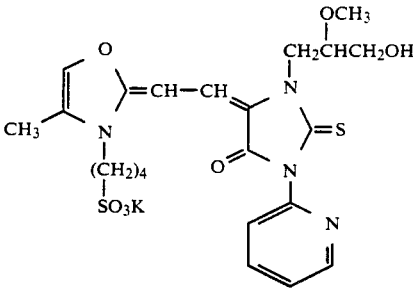
II-16
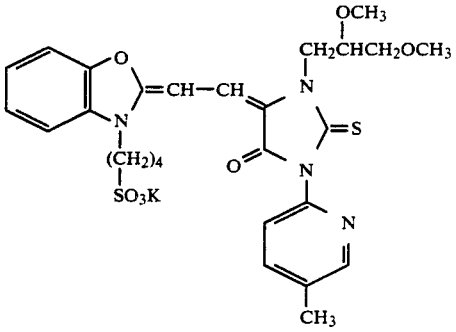
II-17

-continued
II-18
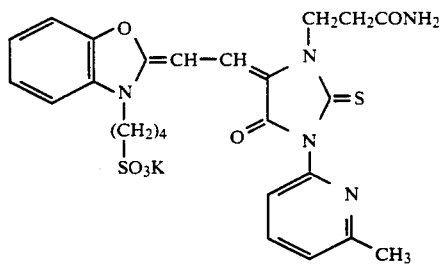
II-19
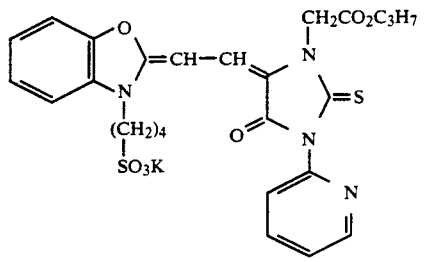
II-20
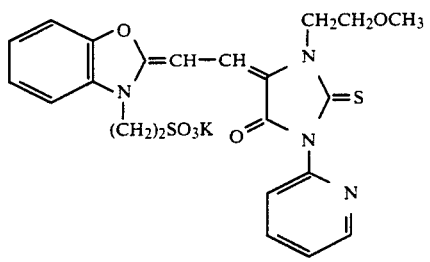
II-21
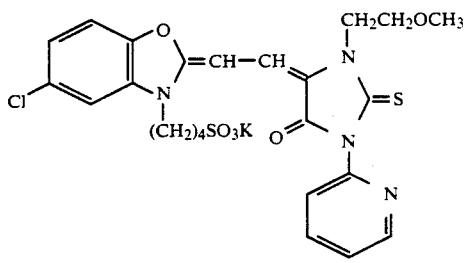
II-22
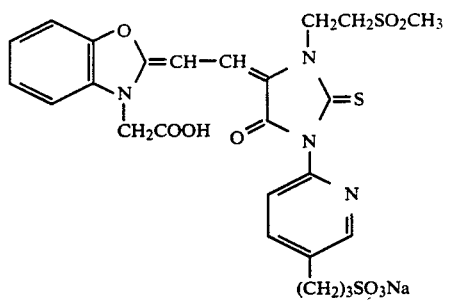
II-23
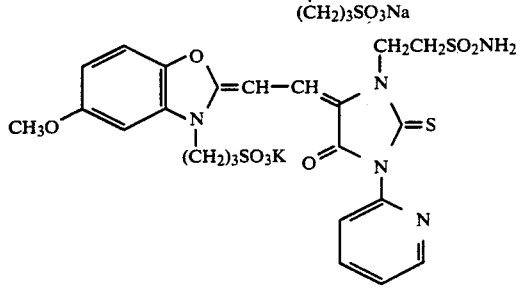

-continued
II-24
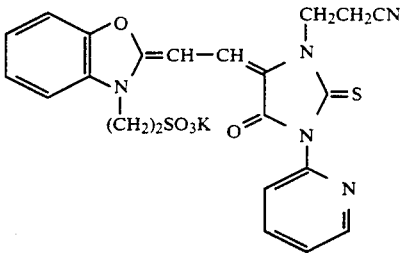
II-25
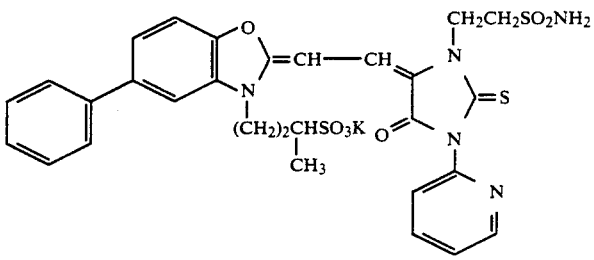
II-26
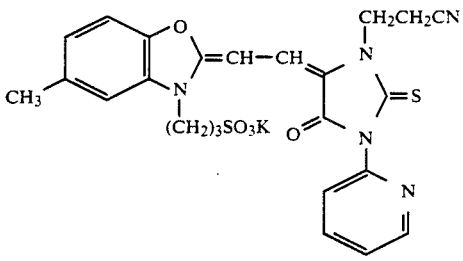
II-27
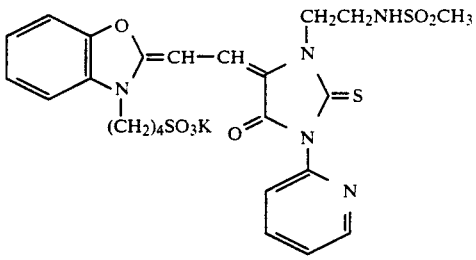
II-28
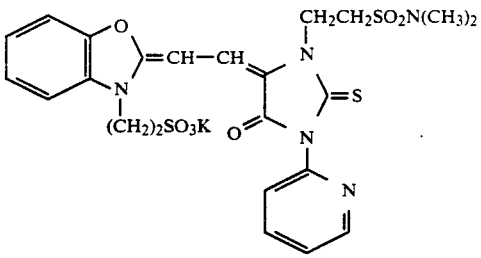
II-29
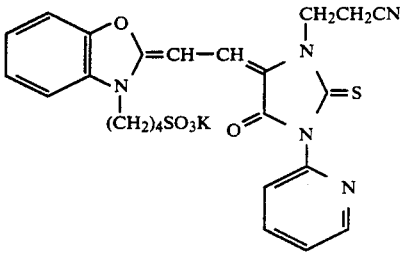

-continued
II-30
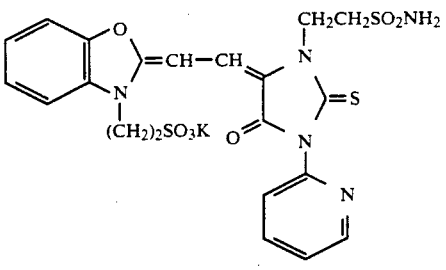
II-31
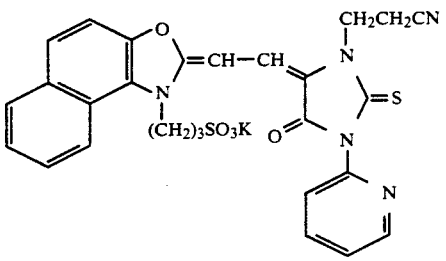
II-32
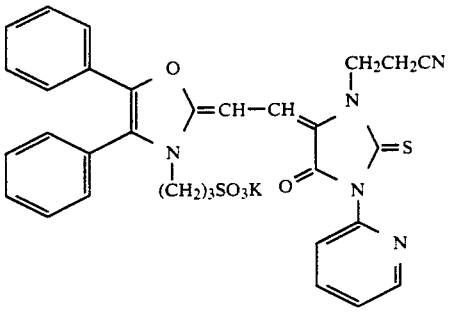
II-33
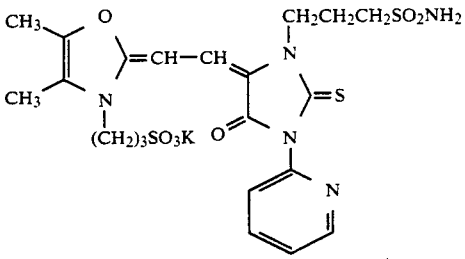
II-34
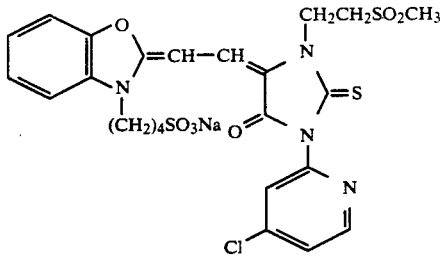
II-35
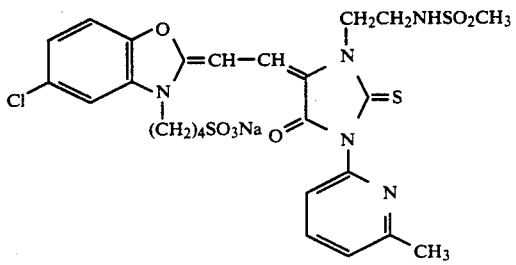

-continued
II-36
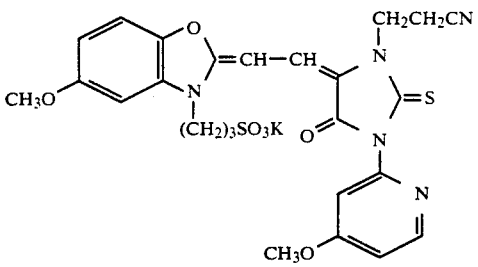
II-37
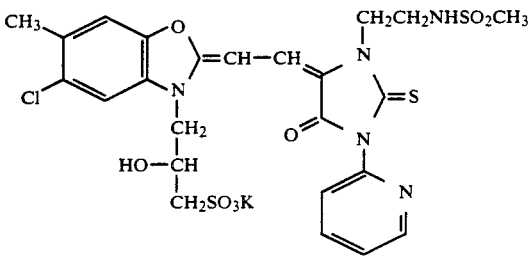
II-38
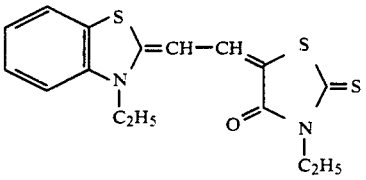
II-39
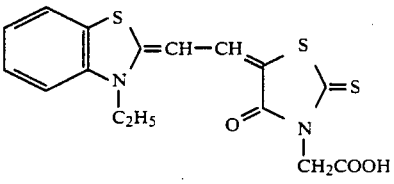
II-40
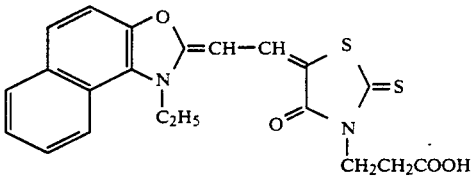
II-41
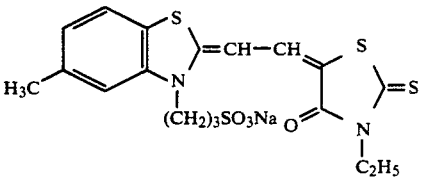
II-42
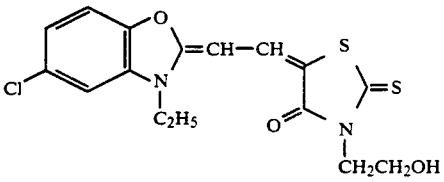

-continued

II-43

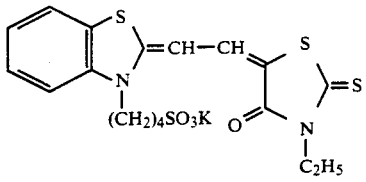

II-44

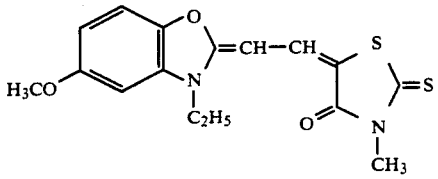

In Formula III, the examples of the heterocyclic rings formed by $Z_5$ and $Z_6$ are a thiazole ring, a selenazole ring, a benzothiazole ring, a benzoselenazole ring, and a naphthothiazole ring, preferably a benzothiazole ring and a benzoselenazole ring, and more preferably a benzothiazole ring.

The above heterocyclic rings may have substituents preferably such as a halogen atom, a hydroxyl group, a cyano group, an aryl group, an alkyl group and an alkoxy group.

The halogen atom is preferably chlorine. The aryl group is preferably phenyl. The alkyl group is preferably a linear or branched alkyl group with 1 to 4 carbon atoms, more preferably methyl. The alkoxy group is preferably an alkoxy group with 1 to 4 carbon atoms, more preferably methoxy.

The alkyl group represented by $R_5$ and $R_6$ is preferably a linear or branched alkyl group with 1 to 6 carbon atoms, which may have a substituent preferably such as a sulfo group, a carboxyl group, a hydroxyl group, an alkoxycarbonyl group and an alkylsulfonylamino group, more preferably a sulfo group and a carboxyl group. The examples of the alkyl group are 2-sulfoethyl, 3-sulfopropyl, 4-sulfobutyl, 3-sulfobutyl, 2-carboxyethyl, 2-ethoxycarbonylethyl, 2-hydroxyethyl, and 2-methylsulfonylaminoethyl.

The sulfo and carboxyl groups may form a salt with an organic ion such as a pyridium ion and a triethylammonium ion, or an inorganic cation such as an ammonium ion, a sodium ion and a potassium ion.

The anion represented by $X_1^{\ominus}$ is the same as that defined for $X^{\ominus}$ in Formula I, provided that l is 1 when an intramolecular salt is formed.

The examples of the dye (3) represented by Formula III are given below:

III-1

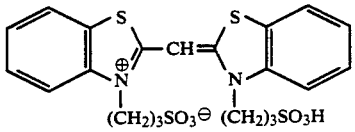

III-2

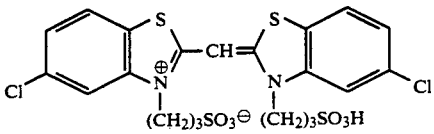

-continued

III-3

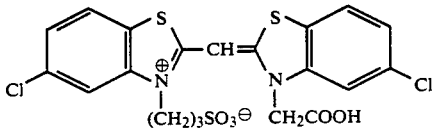

III-4

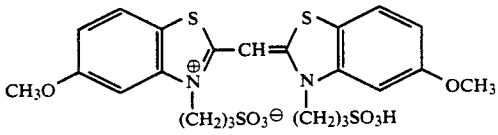

III-5

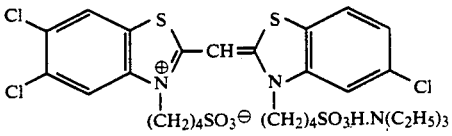

III-6

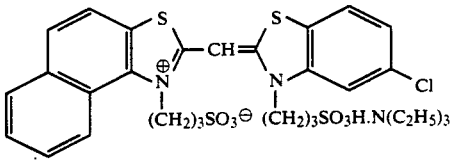

III-7

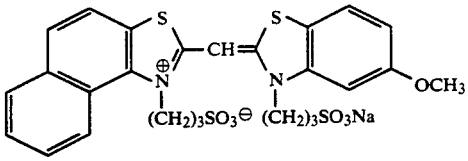

III-8

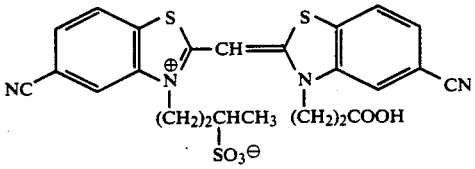

III-9

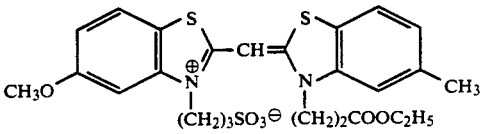

-continued

III-10

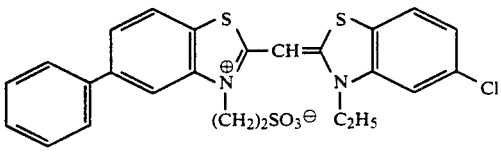

III-11

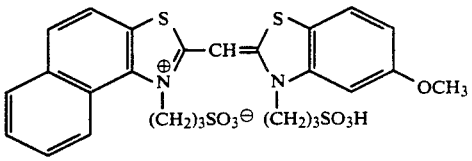

III-12

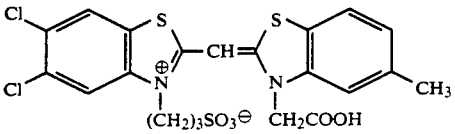

III-13

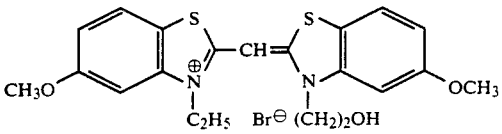

III-14

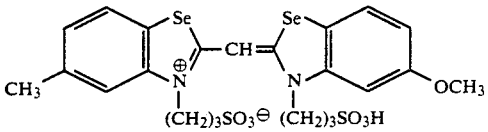

III-15

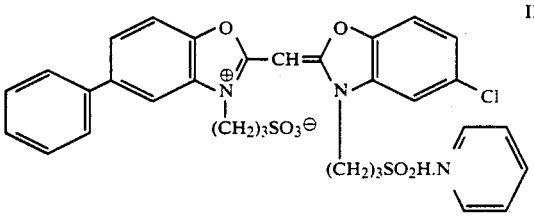

III-16

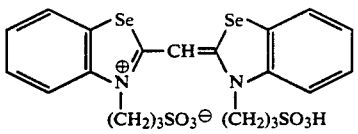

III-17

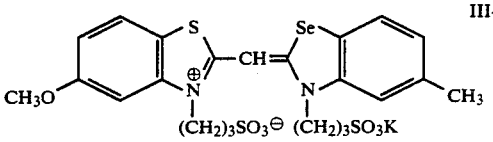

III-18

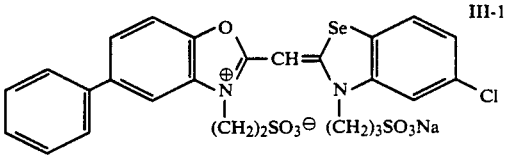

-continued

III-19

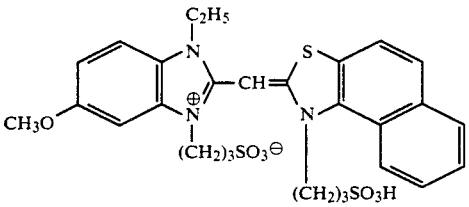

III-20

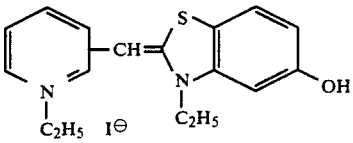

The sensitizing dyes (1), (2) and (3) represented by Formulae I to III are known in the art and can be prepared by the methods described in the Chemistry of Heterocyclic Compounds, Vol. 18 written by A. M. Halmer; The Cyanine Dyes and Related Compounds, A. Weissberger (New York: Interscience, 1964);

Japanese Patent Examined Publication Nos. 549/1971, 18105/1971, 18106/1971, 18108/1971, 4085/1972, and 52574/1983, U.S. Pat. Nos. 2,839,403, 3,381,486, 3,625,698, 3,480,439, and 3,567,458.

The addition amount thereof is $1\times10^{-7}$ to $1\times10^{-3}$ mole, preferably $5\times10^{-6}$ to $5\times10^{-4}$ mole per mole of silver halide.

Addition timing of these sensitizing dyes is usually after the formation of silver halide grains or physical ripening, or at an early or later stage of chemical ripening.

The ratio of the dyes (1) and (2) or (1), (2) and (3) is not limited and determined appropriately within the range of the preceding addition amounts.

In recent years, a water-proof paper coated with polyolefin such as polyethylene is widely employed as a support for photographic printing paper.

It is an ordinary technique to use polyolefin containing a white inorganic pigment such as a titanium oxide and a zinc oxide or a fluorescent brightening agent to increase whiteness of paper.

Whiteness (tone) of paper can be measured by the method described in JIS.Z. 8722 and JIS.Z. 8730, in which the tone of paper is expressed in L (brightness), $a^*$ (redness) and $b^*$ (yellowness) and the reflection properties are expressed by the numerals thereof.

In the present invention, visual whiteness of an unexposed area on a processed photographic material can be improved by controlling a surface tone of a polyolefin-coated paper at a prescribed level.

L is not less than 90, preferably not less than 92. To obtain a brighter image, a higher L value is preferable.

$a^*$ is $-0.5$ to 1.0, preferably $-0.1$ to 0.8.

$b^*$ is $-1.5$ to $-5.0$, preferably $-1.0$ to $-4.0$.

The reflection properties falling within the above ranges of L, $a^*$ and $b^*$ can be obtained by adding to a polyolefin layer a white pigment, an inorganic bluing agent such as ultramarine, a red or purple coloring agent, or a fluorescent brightening agent.

The values of L, $a^*$ and $b^*$ can be measured by a color analyzer.

In the present invention, it is preferable to control a sensitivity (SB) in 430 nm, a sensitivity (SG) in 540 nm and a sensitivity SR) in 700 nm of the photographic material so that the respective sensitivities satisfy the following equations:

$$0<SB/SG\leqq 0.8$$

$$0<SR/SG\leqq 0.8$$

Each sensitivity can be measured by a conventional method with a color filter in the following manner: the photographic material is exposed for one second through a continuous wedge and a prescribed filter with a 400 lux tungsten light sensitometer Model 2854K; the exposed material is developed in a developer prepared by diluting a developer D-72 made by Kodak with double quantity water for 90 seconds at 20° C. and is fixed in a fixing solution F-5 made by Kodak for 5 minutes at 20° C., followed by washing and drying; the filters used are KL-43 for SB, KL-54 for SG and KL-70 for SR, each manufactured by Toshiba Glass Co.

The sensitivity can be determined by the following equation, provided that H is the exposure (lux x second) necessary for obtaining density of the minimum density (Dmin)+0.6:

Sensitivity=100/H

The photographic material of the invention is characterized by the following points: (1) the balance of the blue-sensitive portion, the green-sensitive portion and the red-sensitive portion is changed to a large extent compared with that of a conventional panchromatic film so that the adverse effects of a color negative on a photoprint (the effects of a yellow layer of a color negative on graininess and a cyan layer thereof on sharpness) can be reduced to balance the improvement of graininess and sharpness; (2) reproducibility of an image printed from a color negative can be improved by providing a red-sensitive portion to an orthomatic film; and (3) a safelight property can be improved by reducing SR relatively to SG.

As stated above, the spectral sensitivities SB, SG and SR have the following relationships:

$$0<SB/SG\leqq 0.8$$

$$0<SR/SG\leqq 0.8$$

Preferably, SB and SG have the following relationship:

$$0.2<SB/SG\leqq 0.7$$

The blue-, green-, and red-sensitivities can be controlled by a grain size of silver halide, chemical sensitization, the kind and amount of a sensitizing dye and a filter dye with a prescribed absorption wavelength. These methods can be employed either singly or in combination.

Silver halide used in the present invention may be anyone of silver chloride, silver bromide, silver bromochloride, silver bromoiodide, silver bromochloroiodide and a mixture thereof, preferably silver bromide, silver bromochloride and silver chloride.

A silver halide emulsion used in the invention can be prepared by conventional methods such as the acid method, the neutral method, the alkali method and the ammonia method, and by the single-jet method, the reverse-jet method, the double-jet method, the pAg-controlled double-jet method and the conversion method.

In the invention, the silver halide emulsion may be doped with cadmium, zinc, lead, thallium, iridium, rhodium, and iron during forming of silver halide grains or pysical ripening.

Gelatin is usually employed as a binder for a silver halide emulsion. Also usable are a gelatin derivative, a graft polymer of gelatin and the other polymers, and proteins such as albumin and casein.

An average grain size of silver halide grains is preferably smaller than 2 μm, and more preferably 0.25 to 0.35 μm to make a blue-sensitivity lower than a green-sensitivity.

The emulsion may be either monodispersed or polydispersed, preferably monodispersed to provide a relatively hard gradation.

In order to control the gradation of a highlight through a shadow, it is effective to use a mixture of two or more monodispersed emulsions, or a mixture of monodispersed and polydispersed emulsions.

The silver halide emulsion used in the invention can be chemically sensitized by various sensitizers such as sulfur sensitizers, noble metal sensitizers and reduction sensitizers. These sensitizers may be employed either singly or in combination.

It is possible to add a fluorescent brightening agent to hydrophilic colloid layers such as an emulsion layer, a protective layer, an interlayer and an undercoating layer so that a surface reflectance is increased to improve apparent whiteness.

It is preferable to incorporate the fluorescent brightening agent into a layer farther from a support. The amount is normally 0.01 to 3.0 mg/dm$^2$, preferably 0.1 to 2.0 mg/dm$^2$.

The examples of the fluorescent brightening agent are given below:

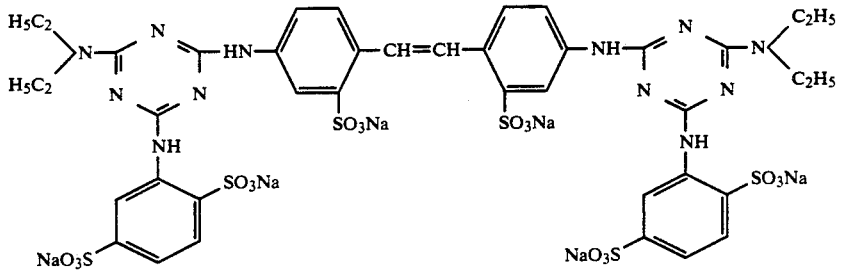

1

-continued

2

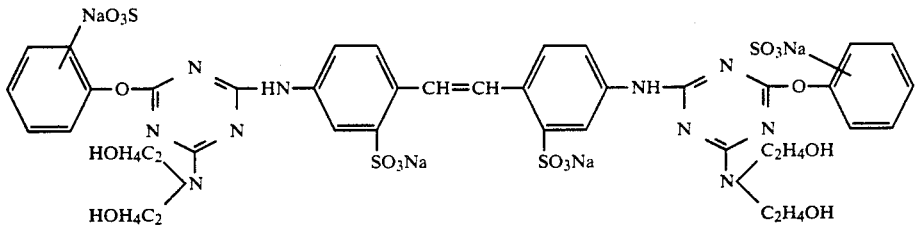

3

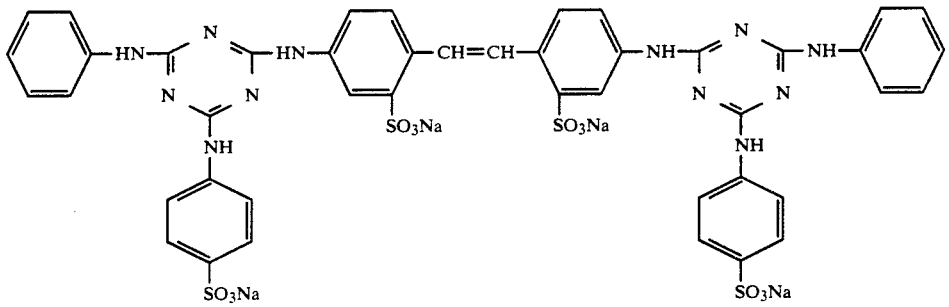

4

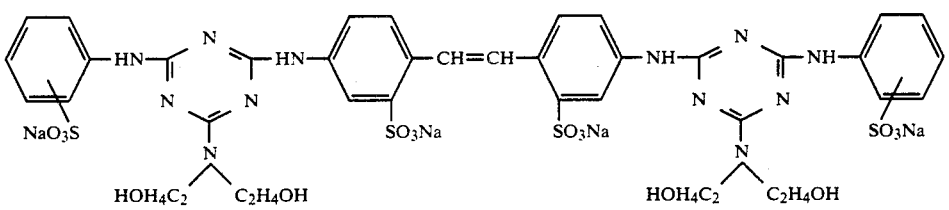

5

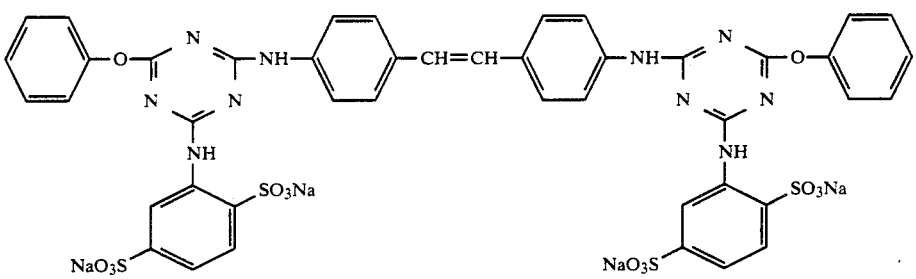

6

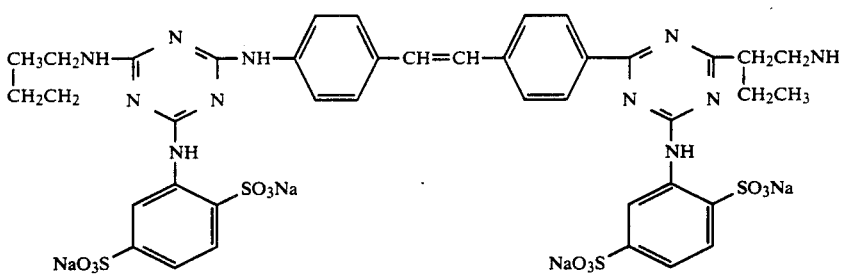

The brightening agent may be incorporated into any of the photographic component layers, preferably a non-emulsion layer.

Various known compounds may be employed as a compound promoting the brightening effect. Especially useful compounds are hydrophilic polymers such as polyvinylpyrrolidone.

Various conventional photographic additives may be added to an emulsion before or after physical or chemical ripening. The examples thereof are described in Research Disclosure Nos. 17643 (December 1978) and 18716 (November 1979).

The conventional developing agents may be used for the development of the light-sensitive material of the invention.

An organic solvent such as an alkanol amine and a glycol may be used for a developer.

pH of the developer is usually 9 to 13, preferably 10 to 12.

A developing temperature is preferably not higher than 50° C., more preferably 30° to 40° C. Developing time is normally shorter than two minutes, preferably shorter than 30 seconds.

The light-sensitive material of the invention may be subjected to stopping, stabilization, fixation and washing.

EXAMPLES

The invention is described in more detail with reference to the following Examples.

EXAMPLE 1

An emulsion was prepared according to the following procedures.

| | |
|---|---|
| Solution I | |
| Gelatin | 20 g |
| Water | 400 ml |
| Solution II | |
| $AgNO_3$ | 60 g |
| Water | 250 ml |
| Aqueous ammonia (28%) | 40 ml |
| Solution III | |
| KBr | 42 g |
| Water | 300 ml |
| Solution IV | |
| 0.5% $K_2IrCl_5$ | 0.75 ml |
| Water | 36.75 ml |

To Solution I was added 0.25 ml of Solution IV (corresponding to an amount of iridium of $2.9\times10^{-7}$ mols per mol silver halide.

Solution I was heated to 35° C. and Solutions II and III were added thereto simultaneously for one minute with vigorous stirring. The mixture was ripened at this temperature for 5 minutes and then, pH was adjusted to 5.8 by acetic acid (20%), and the temperature was raised to 40° C.

The liquid was then desalted with Demor N (manufactured by Kao Corp) and magnesium sulfate and dispersed again by adding gelatin, to thereby prepare a monodispersed silver halide emulsion containing cubic silver bromide grains with an average grain size of 0.3 μm. The emulsion was chemically sensitized with sodium thiosulfate, followed by the addition of the following SB-1 as a stabilizer.

Next, the emulsion was subjected to spectral sensitization with the dyes I-7 and II-24 and the comparative dyes (A) and (B) as shown in Table 1.

Stabilizer SB-1

4-hydroxy-6-methyl-1,3,3a,7-tetrazaindene

Comparative sensitizing dye (A)

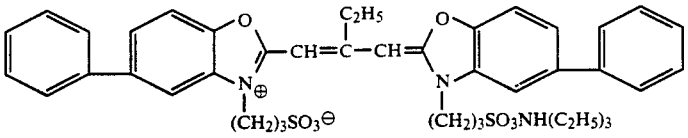

Comparative sensitizing dye (B)

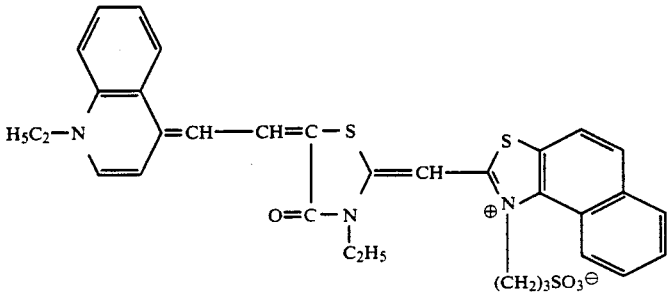

The coating solutions for an emulsion layer and a protective layer were coated simultaneously on a paper support (thickness: 200 μm) coated on the both sides thereof with polyolefin containing blue-shade ultramarine and red-shade ultramarine pigments so that the surface reflection characteristics (L, a*, b*) of the support were controlled to such values as shown in Table 1, whereby there were prepared the photographic material samples comprising the emulsion layer and the protective layer each having the following composition:

| | |
|---|---|
| Emulsion layer | |
| Gelatin | 2.8 g/m² |
| AgX as silver | 1.4 g/m² |
| Tone controlling agent: 1-phenyl-5-mercaptotetrazole | 1.5 mg/m² |
| Fluorescent brightening agent 3: | shown in Table 1 |
| Coating aid: sodium dodecylbenzene sulfonate | 10 mg/m² |
| Protective layer | |
| Gelatin | 1.5 g/m² |
| Coating aid: sodium dodecylbenzene sulfonate | 50 mg/m² |
| Hardener: sodium 2,4-dichloro-6-hydroxy-s-triazine | 10 mg/m² |

These samples were stored at 40° C. and RH80% for 4 days and processed by the following steps:

| Processing | Agent | Conditions |
|---|---|---|
| Development | Konicatone (manufactured by Konica Corp.) | 20° C., 90 sec |
| Stopping | Glacial acetic acid | 20° C., 15 sec |
| Fixation | Konicafix (manufactured by Konica Corp.) | 20° C., 5 min |
| Rinsing | Running water | — 5 min |

The processed samples were evaluated for the following items:

(1) Whiteness

Each sample was cut into a cabinet size and processed under the preceding conditions without exposing to thereby prepare white samples.

Each white sample was placed under the standard light source for image evaluation and visually observed by five monitors arbitrarily chosen according to the following criterion:

○: Good

Δ: Fair, no problem in practical use x: Bad, no practicability.

(2) Image quality

Macbeth color chart, a person and a landscape were photographed with Konica Color GX-400 manufactured by Konica, which was subjected to processing for a color negative. The negative was printed on the above samples. The printed images were evaluated for reproducibility in terms of a density of a silver image, sharpness and graininess.

◎: Very excellent

○: Good

Δ:Fair, no problem in practical use x: Bad, no practicability

The results are shown in Table 1.

(2) Samples No. 4 to 10 each containing the comparative sensitizing dyes (A) and (B) have the improved reproducibility, sharpness and graininess, since they are sensitive not only in a regular region but also in the orthomatic and panchromatic regions. However, whiteness thereof is inferior in spite of using the support having L, *a and *b falling within the limits of the invention.

(3) Samples No. 11 to 25 containing the sensitizing dyes related to the invention have excellent and balaced reproducibility, sharpness and graininess. Samples No. 14 to 19 and 23 to 25 each using the support related to the invention have excellent whiteness because of no stain attributable to no residul dyes while Samples No. 11 to 13 and 20 to 22 each using a support out of the invention have poor whiteness.

(4) Samples No. 24 to 25 each containing the sensitizing dyes related to the invention and a fluorescent brightening agent have very excellent whiteness.

EXAMPLE 2

Samples No. 28 to 46 were prepared in the same manner as in Example 1, except that the amounts of the sensitizing dyes were varied to control the sensitivity of each color-sensitive portion (the regular, ortho and panchromatic portions) as shown in Table 2.

TABLE 1

| | Color Data of support | | | Sensitizing dye (mg/mol Ag) | | | | | | | | |
|---|---|---|---|---|---|---|---|---|---|---|---|---|
| | | | | Dye (2) | Dye (1) | Comparative | | | | | | |
| Sample No. | L | a* | b* | II-24 | I-7 | (A) | (B) | Whiteness | Reproducibility | Sharpness | Graininess | Remarks |
| 1 (Comparative) | 96.0 | −0.4 | 1.3 | — | — | — | — | x (Strongly yellowish) | x | ○ | x | |
| 2 (Comparative) | 93.4 | −0.4 | −1.0 | — | — | — | — | x (Strongly yellowish) | x | ○ | x | |
| 3 (Comparative) | 92.2 | −0.4 | −1.8 | — | — | — | — | ○ | x | ○ | x | |
| 4 (Comparative) | 92.2 | −0.4 | −1.8 | — | — | 20 | 6 | x (Strongly reddish) | Δ | Δ | ○ | |
| 5 (Comparative) | 92.2 | −0.4 | −1.8 | — | — | 40 | 6 | x (Strongly reddish) | ○ | Δ | ○ | |
| 6 (Comparative) | 92.2 | −0.4 | −1.8 | — | — | 60 | 6 | x (Strongly reddish) | ○ | Δ | Δ | |
| 7 (Comparative) | 96.0 | −0.4 | 1.3 | — | — | 60 | 6 | x (Strongly red-yellowish) | ○ | Δ | Δ | |
| 8 (Comparative) | 92.0 | −0.4 | −2.5 | — | — | 20 | 6 | x (Strongly red-bluish) | Δ | ○ | ○ | |
| 9 (Comparative) | 92.0 | −0.4 | −2.5 | — | — | 40 | 6 | x (Strongly red-bluish) | ○ | Δ | Δ | |
| 10 (Comparative) | 92.0 | −0.4 | −2.5 | — | — | 60 | 6 | x (Strongly red-bluish) | ○ | Δ | Δ | |
| 11 (Comparative) | 96.0 | −0.4 | 1.3 | 28 | 6 | — | — | x (Strongly yellowish) | ○ | Δ | ○ | |
| 12 (Comparative) | 96.0 | −0.4 | 1.3 | 56 | 6 | — | — | x (Strongly yellowish) | ○ | Δ | ○ | |
| 13 (Comparative) | 96.0 | −0.4 | 1.3 | 84 | 6 | — | — | x (Strongly yellowish) | ○ | Δ | ○ | |
| 14 (Invention) | 92.2 | −0.4 | −1.8 | 28 | 6 | — | — | ○ | ○ | ○ | ○ | |
| 15 (Invention) | 92.2 | −0.4 | −1.8 | 56 | 6 | — | — | ○ | ○ | ○ | ○ | |
| 16 (Invention) | 92.2 | −0.4 | −1.8 | 84 | 6 | — | — | ○ | ○ | ○ | ○ | |
| 17 (Invention) | 92.2 | −0.4 | −1.8 | 113 | 6 | — | — | Δ (Slightly reddish) | ○ | ○ | ○ | |
| 18 (Invention) | 92.0 | −0.4 | −2.5 | 84 | 6 | — | — | ○ | ○ | ○ | ○ | |
| 19 (Invention) | 90.5 | −0.2 | −3.0 | 84 | 6 | — | — | ○ | ○ | ○ | ○ | |
| 20 (Comparative) | 89.0 | −0.1 | −4.2 | 84 | 6 | — | — | x (Dull) | ○ | ○ | ○ | |
| 21 (Comparative) | 90.2 | −0.2 | −5.3 | 84 | 6 | — | — | x (Strongly bluish) | ○ | ○ | ○ | |
| 22 (Comparative) | 90.3 | −0.4 | −6.0 | 84 | 6 | — | — | x (Strongly bluish) | ○ | ○ | ○ | |
| 23 (Invention) | 92.1 | −0.2 | −2.0 | 84 | 6 | — | — | ○ | ○ | ○ | ○ | *Fluorescent brightening agent |
| 24 (Invention) | 92.1 | −0.2 | −2.0 | 84 | 6 | — | — | ◎ | ○ | ○ | ○ | Fluorescent brightening agent 50 mg/m$^2$ |
| 25 (Invention) | 92.1 | −0.2 | −2.0 | 84 | 6 | — | — | ◎ | ○ | ○ | ○ | Fluorescent brightening agent 50 mg/m$^2$ |

The following have been found from the results shown in Table 1:

(1) Samples No. 1 to 3 each containing no sensitizing dye have poor reproducibility and graininess.

The sensitivities of the color-sensitive portions, SB in 430 nm, SG in 540 nm and SR in 700 nm were measured in the preceding manner.

Each sample was evaluated in the same manner as in Example 1. The results are shown in Table 2.

TABLE 2

| Sample No. | Color data of support L | a* | b* | Sensitizing dye (mg/mol Ag) | | | Color-sensitivity ratio SB/SG | SR/SG | Reproducibility | Sharpness | Graininess | Whiteness |
|---|---|---|---|---|---|---|---|---|---|---|---|---|
| | | | | Dye (3) III-2 | Dye (2) II-39 | Dye (1) I-10 | | | | | | |
| 26 (Comparative) | 93.2 | −0.1 | −2.0 | — | — | — | — | — | x | ○ | x | ○ |
| 27 (Comparative) | 93.2 | −0.1 | −2.0 | — | 60 | — | 1.63 | — | x | ○ | x | ○ |
| 28 (Comparative) | 93.2 | −0.1 | −2.0 | 120 | 60 | — | 1.05 | — | x | ○ | x | ○ |
| 29 (Invention) | 93.2 | −0.1 | −2.0 | — | 20 | 6 | 0.95 | 0.90 | Δ | Δ | ○ | ○ |
| 30 (Invention) | 93.2 | −0.1 | −2.0 | — | 40 | 6 | 0.83 | 0.85 | Δ | Δ | ○ | ○ |
| 31 (Invention) | 93.2 | −0.1 | −2.0 | — | 60 | 6 | 0.71 | 0.78 | ○ | ○ | ○ | ○ |
| 32 (Invention) | 93.2 | −0.1 | −2.0 | — | 80 | 6 | 0.63 | 0.72 | ○ | ○ | ○ | ○ |
| 33 (Invention) | 93.2 | −0.1 | −2.0 | — | 80 | 2 | 0.61 | 0.25 | Δ | ○ | Δ | ○ |
| 34 (Invention) | 93.2 | −0.1 | −2.0 | — | 80 | 4 | 0.60 | 0.53 | Δ | ○ | Δ | ○ |
| 35 (Invention) | 93.2 | −0.1 | −2.0 | — | 80 | 8 | 0.57 | 0.88 | ○ | Δ | ○ | ○ |
| 36 (Invention) | 93.2 | −0.1 | −2.0 | — | 80 | 10 | 0.55 | 1.02 | ○ | Δ | ○ | ○ |
| 37 (Invention) | 93.2 | −0.1 | −2.0 | 120 | 80 | 6 | 0.92 | 0.70 | ○ | ○ | Δ | ○ |
| 38 (Comparative) | 96.0 | −0.8 | −0.5 | — | 80 | 6 | 0.63 | 0.72 | ○ | ○ | ○ | x (Strongly yellowish) |
| 39 (Comparative) | 94.1 | −2.1 | −2.2 | — | 80 | 6 | 0.63 | 0.72 | ○ | ○ | ○ | x (Strongly reddish) |
| 40 (Comparative) | 92.2 | −0.1 | −6.3 | — | 80 | 6 | 0.63 | 0.72 | ○ | ○ | ○ | x (Strongly bluish) |
| 41 (Comparative) | 86.7 | −0.3 | −4.8 | — | 80 | 6 | 0.63 | 0.72 | ○ | ○ | ○ | x (Dull) |
| | | | | Dye (3) III-3 | Dye (2) II-29 | Dye (1) I-6 | | | | | | |
| 42 (Invention) | 92.4 | −0.5 | −2.8 | — | 25 | 4.5 | 0.91 | 0.93 | ○ | Δ | Δ | ○ |
| 43 (Invention) | 92.4 | −0.5 | −2.8 | — | 45 | 4.5 | 0.80 | 0.82 | ○ | Δ | ○ | ○ |
| 44 (Invention) | 92.4 | −0.5 | −2.8 | — | 85 | 4.5 | 0.73 | 0.75 | ○ | ○ | ○ | ○ |
| 45 (Invention) | 92.4 | −0.5 | −2.8 | — | 110 | 4.5 | 0.58 | 0.64 | Δ | ○ | ○ | (Slightly reddish) |
| 46 (Invention) | 92.4 | −0.5 | −2.8 | 90 | 85 | 4.5 | 0.81 | 0.77 | ○ | ○ | Δ | ○ |

It is apparent from the results of Table 2 that the samples of the invention comprising the support and sensitizing dyes each related to the invention have more excellent and balanced results in all the evaluated properties than those of the comparative samples.

What is claimed is:

1. A silver halide light-sensitive photographic material comprising a support and provided thereon photographic component layers including at least one silver halide emulsion layer, wherein the surface of the support on which the emulsion layer is provided has the following reflection properties:

L=90 or more $a^*=-0.5$ to 1.0

$b^*=-5.0$ to $-1.5$ and the silver halide emulsion layer contains at east one each of the dye (1) represented by Formula I and the dye (2) represented by formula II:

Formula I

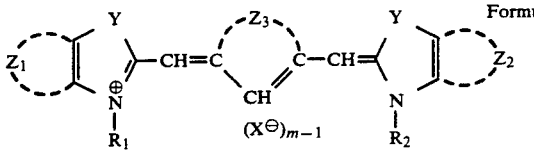

wherein $R_1$ and $R_2$, each represent an alkyl group; $Z_1$ and $Z_2$ each represent the group of non metallic atoms necessary to form a benzene ring and a naphthalene ring each condensed with a thiazole ring or a selenazole ring; $Z_3$ represents the group of atoms necessary to form a six-membered hydrocarbon ring; $X^{\ominus}$ represents an anion; Y represents a sulfur atom or a selenium atom; and m is 1 or 2;

Formula II

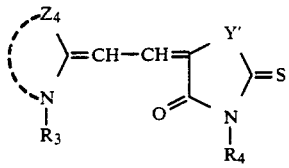

where $Z_4$ represents the group of non-metallic atoms necessary to form an oxazole ring, a benzoxazole ring, a naphthoxazole ring, a thiazole ring, a benzothiazole ring, a naphthothiazole ring, and a thiazoline ring; Y' represents a sulfur atom or —NR'—, in which R' represents an alkyl group or an aryl group; $R_3$ represents an alkyl group; and $R_4$ represents an alkyl group, an aryl group or a pyridinyl group.

2. The photographic material of claim 1, wherein the silver halide emulsion layer further contains the dye (3) represented by Formula III:

Formula III

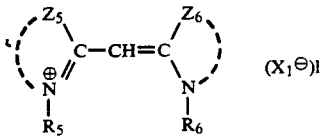

wherein $Z_5$ and $Z_6$ each represent the group of non-metallic atoms necessary to form an oxazole ring, a benzoxazole ring, a naphthoxazole ring, a thiazole ring, a benzothiazole ring, a naphthothiazole ring, a selenazole ring, a benzoselenazole ring, a naphthoselenazole ring, a benzoimidazole ring, a naphthoimidazole ring, a pyridine ring, and a quinoline ring, $R_5$ and $R_6$ each represent an alkyl group, an alkenyl group and an aryl group; $X_1^{\ominus}$ represents an anion; and l is 0 or 1.

3. The photographic material of claim 2, wherein each of the dyes (1), (2) and (3) is added in an amount of $1\times10^{-7}$ to $1\times10^{-3}$ mol per mol of silver halide.

4. The photographic material of claim 11, wherein the amount is $5\times10^{-6}$ to $5\times10^{-4}$ mol per mol of silver halide.

5. The photographic material of claim 4, wherein silver halide is silver chloride, silver bromide or silver bromochloride.

6. The photographic material of claim 5, wherein the average grain size is 0.25 μm to 0.35 μm.

7. The photographic material of claim 1, wherein L is 92 or more.

8. A photographic material of claim 1, wherein a* is −0.1 to 0.8.

9. The photographic material of claim 1, wherein b* is −4.0 to −1.0.

10. The photographic material of claim 1, comprising the spectral sensitivities satisfying the following equations:

$$0<SB/SG\leqq0.8$$

$$0<SR/SG\leqq0.8$$

provided that SB, SG and SR represent the spectral sensitivities in 430, 540 and 700 nm, respectively.

11. The photographic material of claim 10, wherein SB and SG satisfy the following equation:

$$0.2<SB/SG\leqq0.7$$

12. The photographic material of claim 1, further comprising a fluorescent brightening agent.

13. The photographic material of claim 12, wherein an addition amount of the fluorescent brightening agent is 0.01 to 3.0 mg/dm$^2$.

14. The photographic material of claim 13, wherein the addition amount is 0.1 to 2.0 mg/dm$^2$.

15. The photographic material of claim 1, wherein silver halide is silver chloride, silver bromide, silver bromochloride, silver bromoiodide or silver bromochloroiodide.

16. The photographic material of claim 15, wherein an average grain size of silver halide is smaller than 2 μm.

17. The photographic material of claim 1 wherein each of dyes (1) and (2) is added in an amount of of $1\times10^{-7}$ to $1\times10^{-3}$ mol per mol of silver halide.

18. The photographic material of claim 17 wherein the silver halide is silver chloride, silver bromide or silver bromochloride.

19. The photographic material of claim 17 wherein dye (I) is represented by any one of formulas I-1 through I-11 and dye (2) is represented by any one of formulas II-1 through II-44, as follows:

I-1

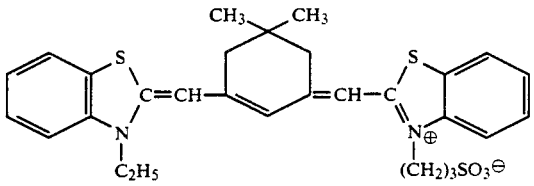

I-2

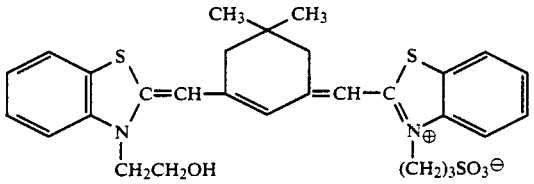

I-3

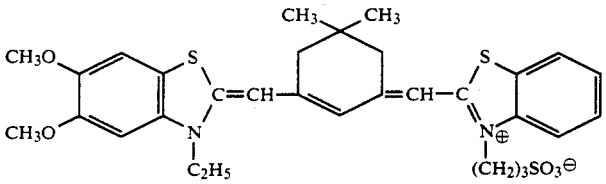

I-4

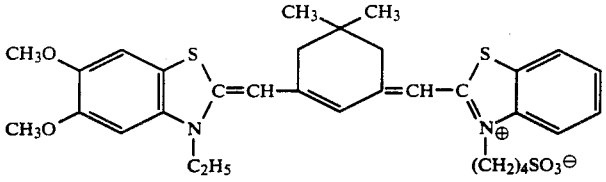

I-5

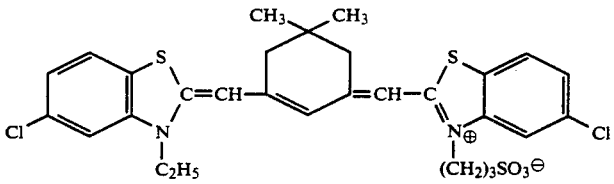

I-6

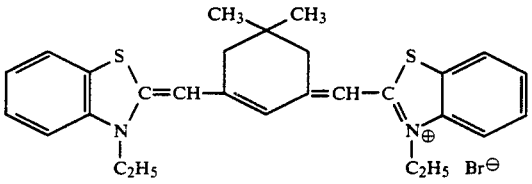

I-7
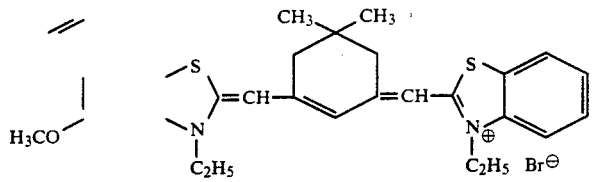
I-8
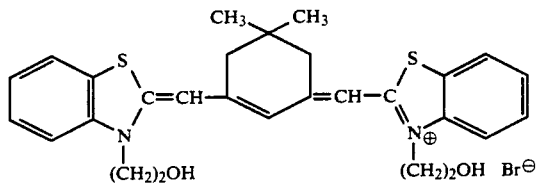
I-9
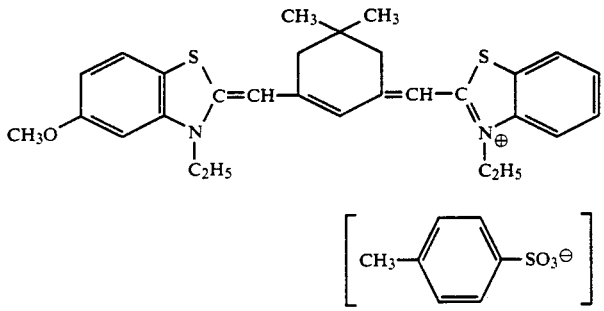
I-10
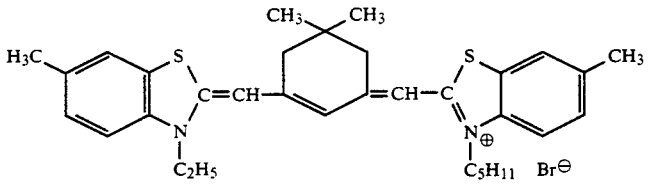
I-11
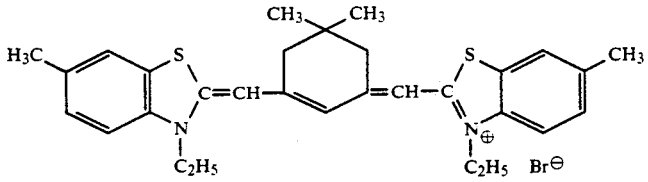
II-1
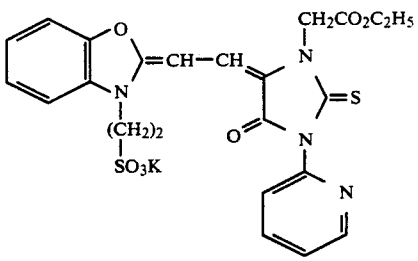
II-2
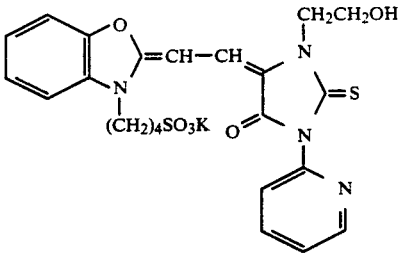
II-3
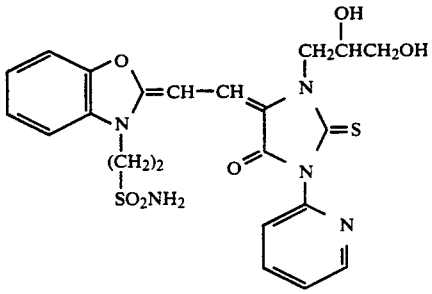
II-4
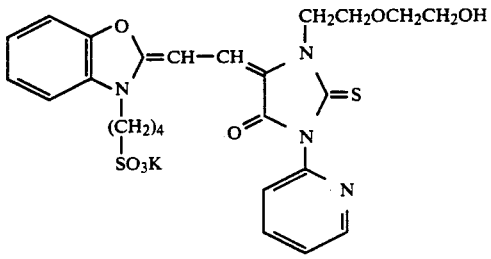

-continued
II-5
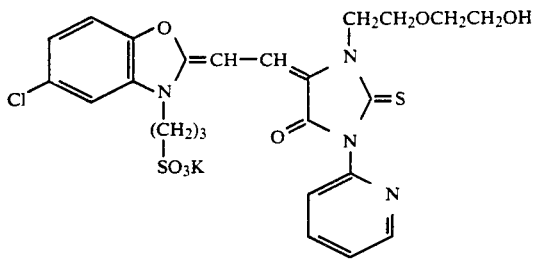
II-6
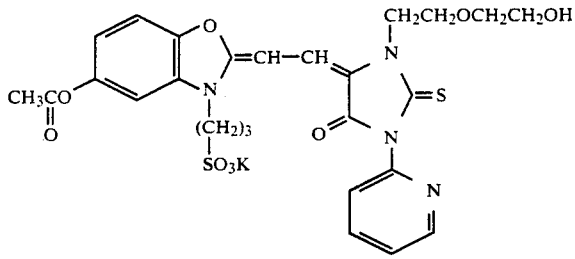
II-7
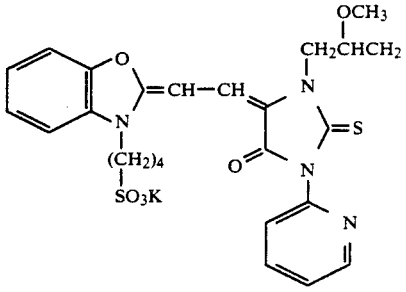
II-8
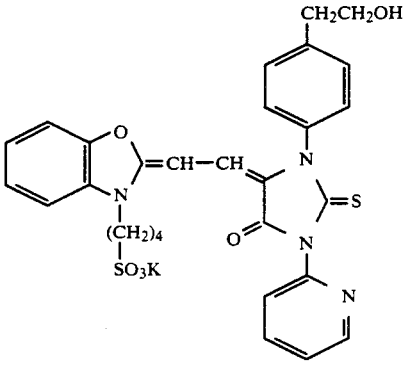
II-9
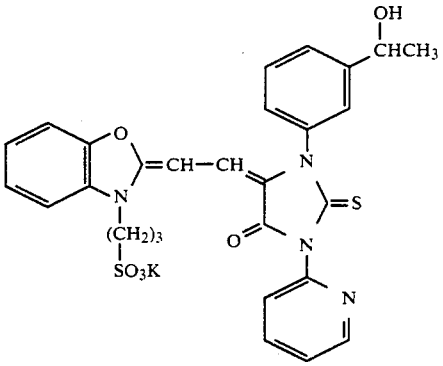
II-10
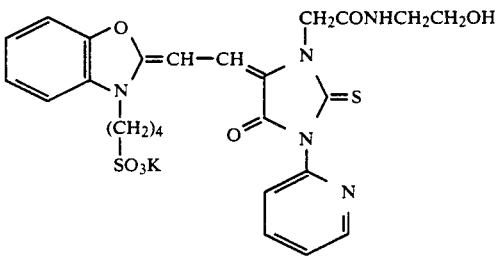
II-11
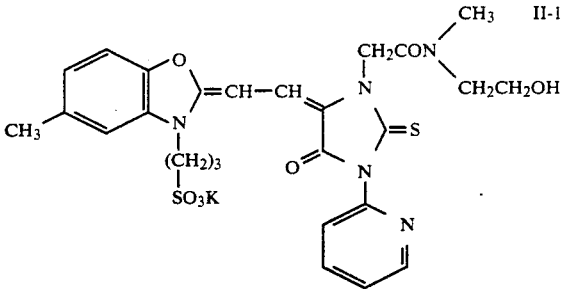
II-12
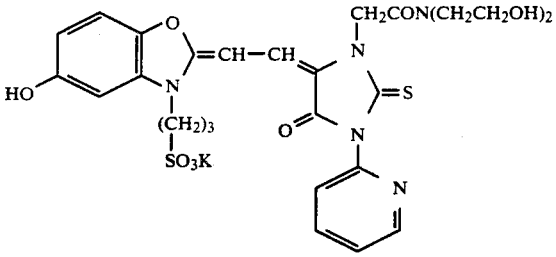
II-13
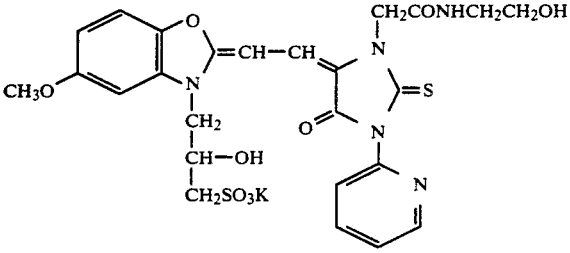
II-14
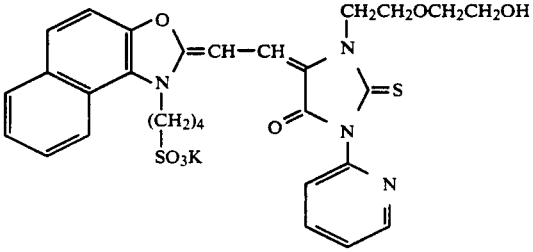

-continued
II-15
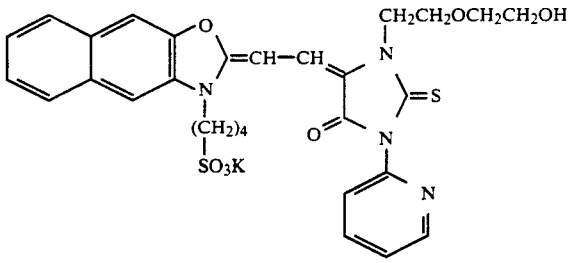
II-16
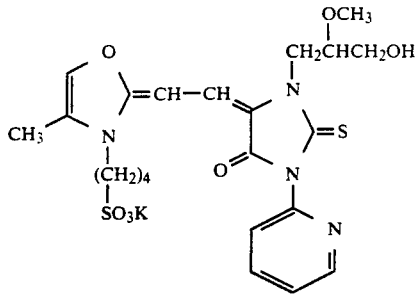
II-17
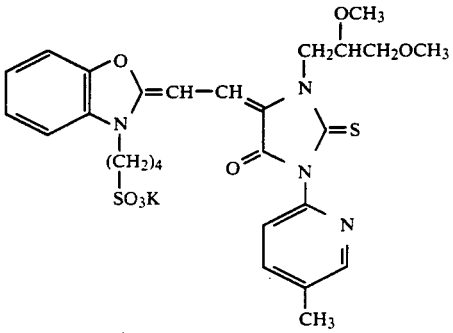
II-18
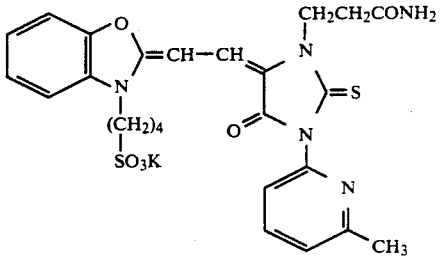
II-19
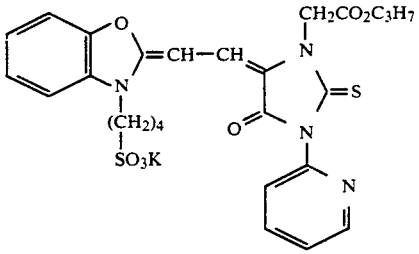
II-20
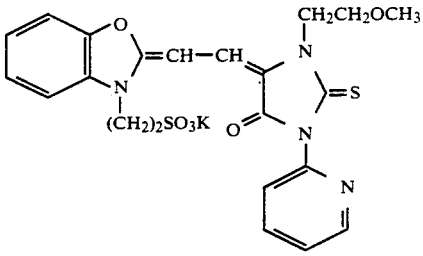
II-21
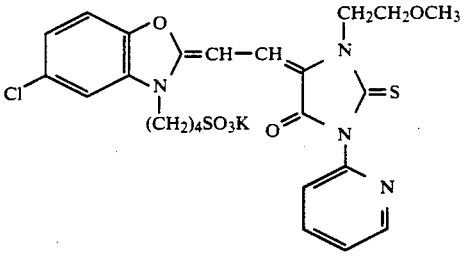
II-22
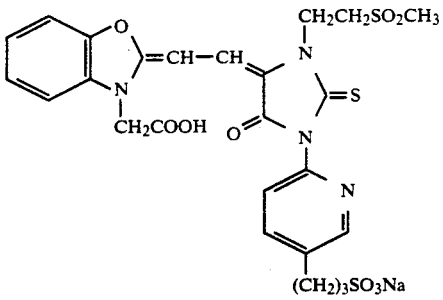
II-23
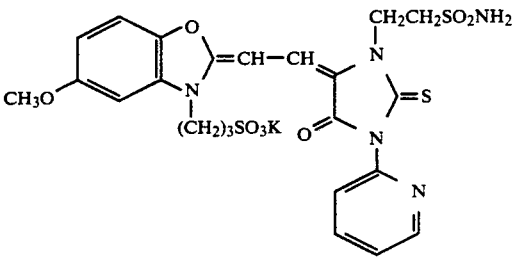
II-24
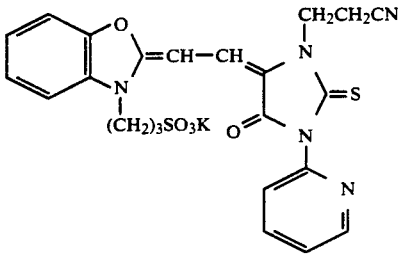

-continued
II-25
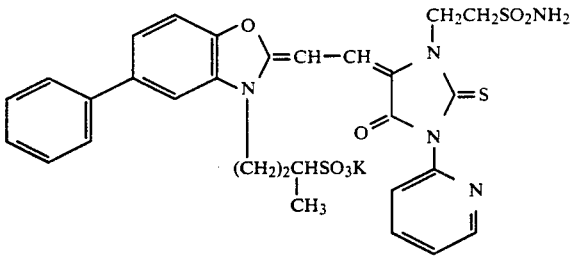
II-26
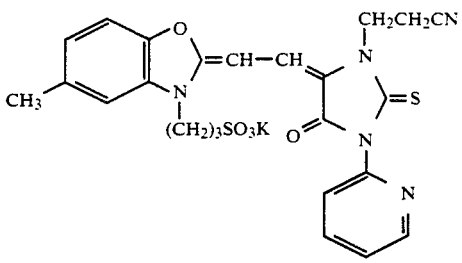
II-27
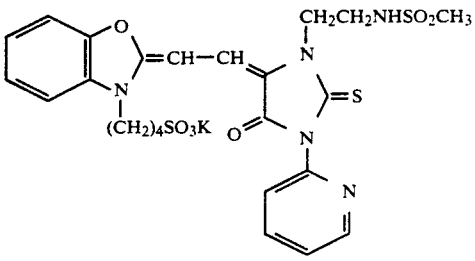
II-28
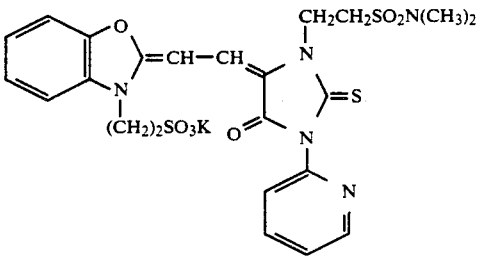
II-29
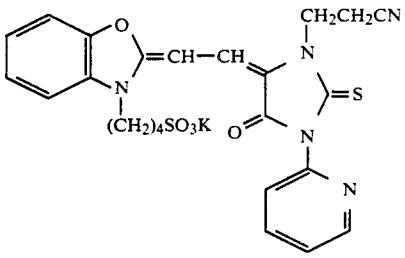
II-30
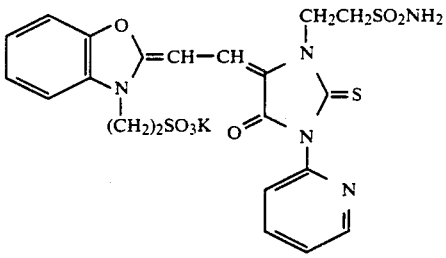
II-31
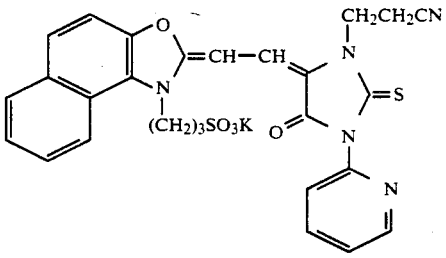
II-32
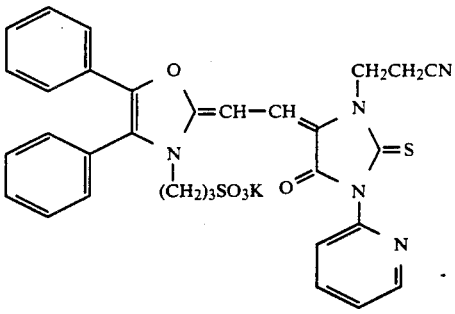
II-33
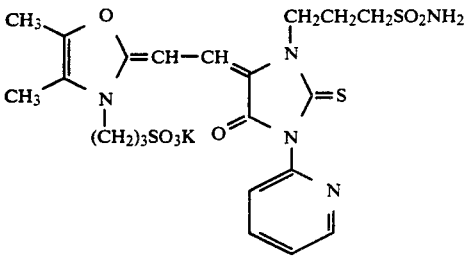
II-34
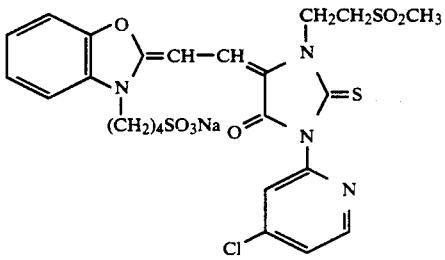

-continued
II-35
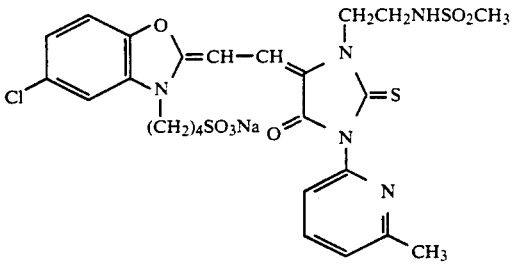
II-36
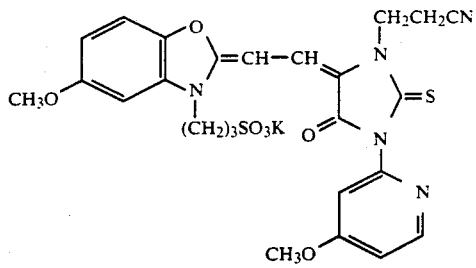
II-37
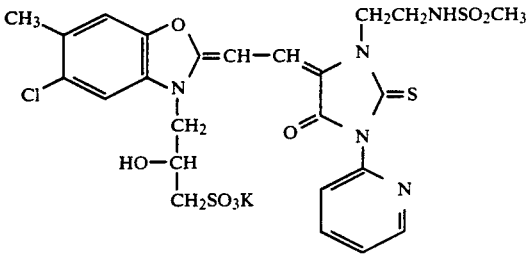
II-38
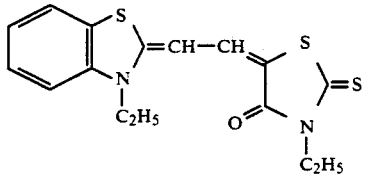
II-39
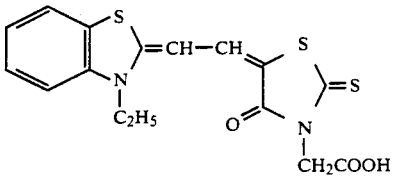
II-40
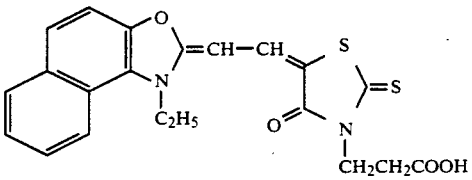
II-41
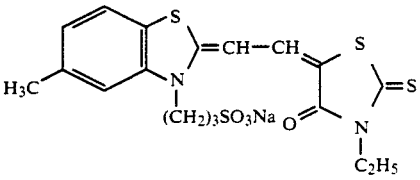
II-42
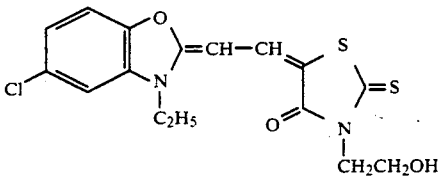
II-43
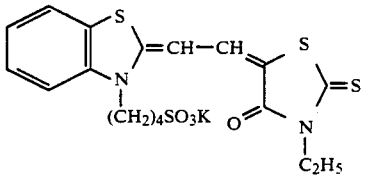
II-44
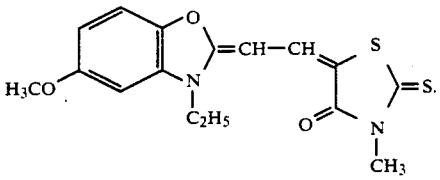
20. The photographic material of claim 19 wherein the silver halide emulsion layer further contains the dye (3) represented by Formulas III-1 through III-20 shown below, in an amount of $1\times10^{-7}$ to $1\times10^{-3}$ mol per mol of silver halide:
III-1
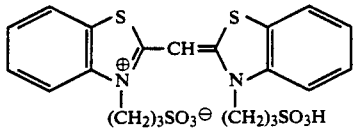
III-2
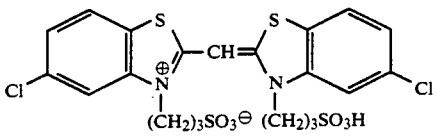
-continued
III-3
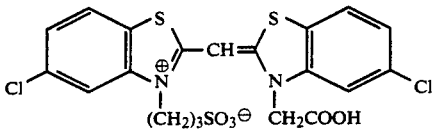
III-4
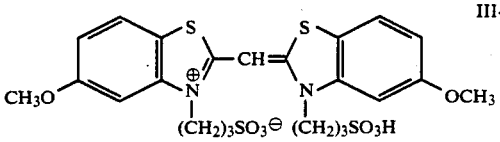
III-5
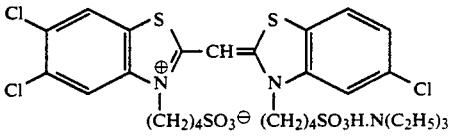

-continued
III-6
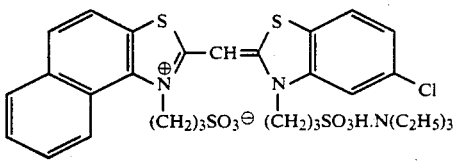
III-7
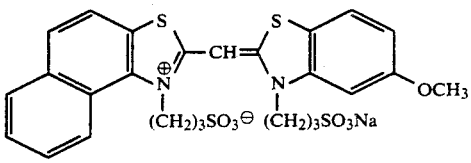
III-8
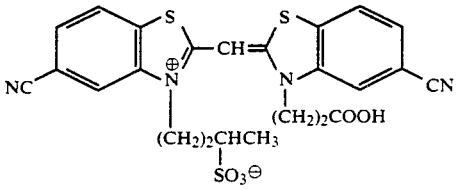
III-9
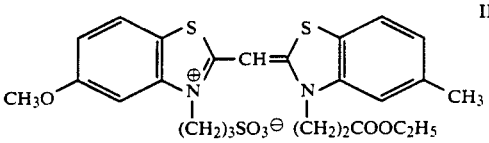
III-10
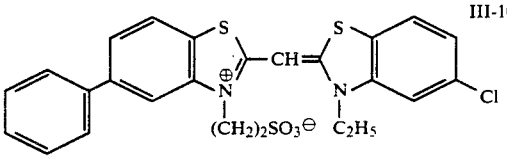
III-11
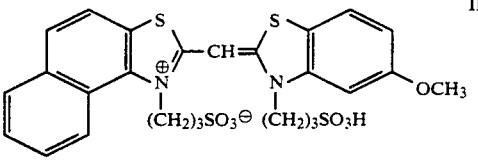
III-12
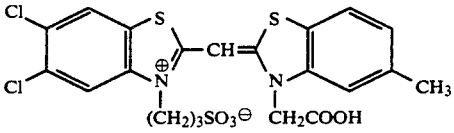
-continued
III-13
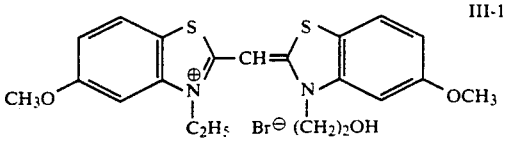
III-14
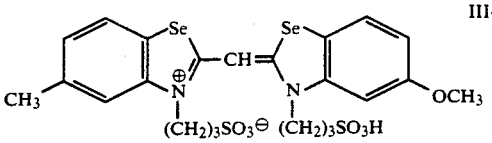
III-15
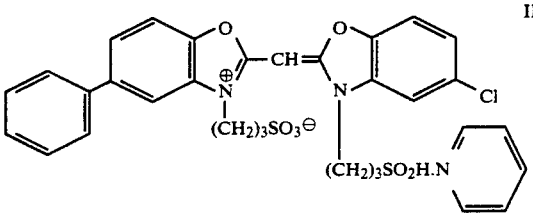
III-16
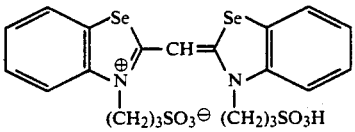
III-17
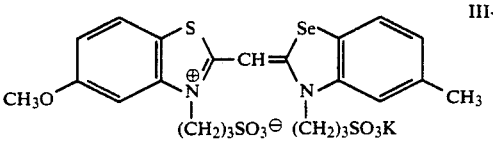
III-18
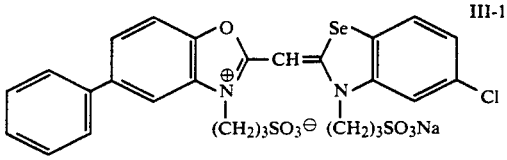
III-19
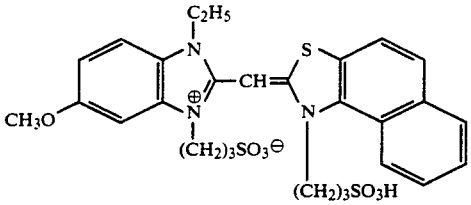
III-20
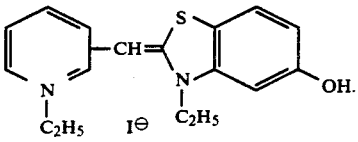
* * * * *